United States Patent [19]

Toshifumi

[11] Patent Number: 4,785,706

[45] Date of Patent: Nov. 22, 1988

[54] APPARATUS FOR GENERATING A MUSICAL TONE SIGNAL WITH TONE COLOR VARIATIONS INDEPENDENT OF TONE PITCH

[75] Inventor: Kunimoto Toshifumi, Hamamatsu, Japan

[73] Assignee: Nippon Gakki Seizo Kabushiki Kaisha, Hamamatsu, Japan

[21] Appl. No.: 940,779

[22] Filed: Dec. 12, 1986

[30] Foreign Application Priority Data

Dec. 17, 1985 [JP] Japan ..... 60-284103

[51] Int. Cl.[4] ..... G10H 1/12; G10H 7/00

[52] U.S. Cl. ..... 84/1.19; 84/1.28; 84/DIG. 9; 84/DIG. 10

[58] Field of Search ..... 84/1.11–1.13, 84/1.19–1.28, 1.01, DIG. 9, DIG. 10

[56] References Cited

U.S. PATENT DOCUMENTS

| | | | |
|---|---|---|---|
| 4,130,043 | 12/1978 | Niimi | 84/1.03 |
| 4,351,219 | 9/1982 | Bass | 84/1.21 |
| 4,655,115 | 4/1987 | Nishimoto | 84/1.19 |
| 4,679,480 | 7/1987 | Suzuki | 84/1.22 |

*Primary Examiner*—Stanley J. Witkowski

*Attorney, Agent, or Firm*—Spensley Horn Jubas & Lubitz

[57] ABSTRACT

A musical tone signal generating apparatus generates a musical tone signal whose tone color can be changed independently of a pitch or a frequency of the musical tone signal. The musical tone signal generating apparatus comprises a shift register on which sampled data of a predetermined waveform are initially loaded. The sampled data in the shift register are shifted at a frequency corresponding to a rate of change of the tone color, and each sampled data shifted out of the shift register is subjected to a predetermined operation such as a multiplication by a predetermined coefficient and is fed back to the shift register. The sampled data in the stages of the shift register are selectively outputted by a selector controlled in accordance with selection control data formed based on the pitch of the musical tone so that the sampled data are outputted at a rate determined by the tone pitch. The musical tone signal is then formed based on the thus outputted sampled data. The shift register may be replaced by a random access memory, in which case the sampled data are sequentially read at a repetition rate determined by the pitch of the musical tone signal and the sampled data in the random access memory are modified at an interval determined by the rate of change of the tone color.

13 Claims, 6 Drawing Sheets

APPARATUS FOR GENERATING A MUSICAL TONE SIGNAL WITH TONE COLOR VARIATIONS INDEPENDENT OF TONE PITCH

BACKGROUND OF THE INVENTION

1. Field of the Invention

This invention relates to a musical tone signal generating apparatus of the type which generates a musical tone signal by sequentially and repeatedly reading a plurality of sampled data of the musical tone signal from a memory.

2. Prior Art

There has been proposed an electronic musical instrument having a musical tone signal generating apparatus of the type which generates a musical tone signal (or a musical tone waveform signal) by sequentially and repeatedly reading, from a memory, a plurality of data previously obtained by sampling the musical tone signal and stored in the memory. Such a musical tone signal generating apparatus is disclosed, for example, in U. S. Pat. No. 4,130,043. This conventional musical tone signal generating apparatus comprises a memory storing a plurality of sampled data which constitute one cycle of a given tone signal, a shift register having a plurality of stages which respectively store the plurality of sampled data read from the memory, and a digital filter circuit provided in a feedback path between output and input terminals of the shift register. The sampled data in the shift register are shifted by a clock signal having a frequency several times as high as a pitch of a tone corresponding to a key depressed on an associated keyboard. The tone signal is formed from the sampled data outputted from the last stage of the shift register. The sampled data sequentially outputted from the last stage of the shift register are also fed through the digital filter circuit back to the first stage of the shift register. As a result, the sampled data stored in each of the stages of the shift register varies at a rate determined by the filtering characteristic of the digital filter in accordance with the time elapsed. Thus, the musical tone signal formed from the sampled data outputted from the last stage of the shift register also varies with the lapse of time, so that the musical tone produced in accordance with the musical tone signal varies with time in tone color.

With such conventional musical tone generating apparatus, the shifting of the sampled data in the shift register is performed in accordance with the clock signal of which frequency is several times as high as the pitch of the tone corresponding to the depressed key of the keyboard. Therefore, the rate of variation of the value of each sampled data which is fed back to the shift register via the feedback path after filtration by the digital filter is substantially proportional to the frequency or pitch of the tone produced. As a result, the rate of change of tone color of a tone produced is proportional to a pitch (or a frequency) of the tone produced. With the conventional apparatus, it has therefore been impossible to give appropriate rates of change of tone color to musical tones corresponding to all the keys of the keyboard which covers several octaves. For example, the tone color of the musical tone of C4 note varies four times faster than that of the musical tone of C2 note. If the filtering characteristic of the digital filter is set to such a value that the tone color of C2 tone varies at an appropriate rate, the tone color of C4 tone will vary at an excessively high rate. On the other hand, if the filtering characteristic of the digital filter is set so that the tone color of C4 tone varies at an appropriate rate, the tone color of C2 tone will vary at an excessively low rate.

SUMMARY OF THE INVENTION

It is therefore an object of the present invention to provide a musical tone signal generating apparatus in which a tone color of each musical tone can be varied at an appropriate rate irrespectively of a tone pitch thereof to thereby improve the quality of each musical tone.

According to an aspect of the present invention, there is provided a musical tone signal generating apparatus comprising memory means for storing a tone wave in the form of plural sampled values; pitch data generating means for generating pitch data representative of a tone pitch of a musical tone signal to be generated; readout means responsive to the pitch data for repeatedly reading out the tone wave from the memory means at a rate corresponding to the tone pitch to form the musical tone signal; modification means for modifying the tone wave for outputting a modified tone wave; and replacing means for replacing the tone wave with the modified tone wave in the memory means at a time interval independent of the rate, whereby the musical tone signal has the tone pitch and varies in waveshape at the time interval independent of the tone pitch.

DESCRIPTION OF THE PREFERRED EMBODIMENTS OF THE INVENTION

Figure 1:
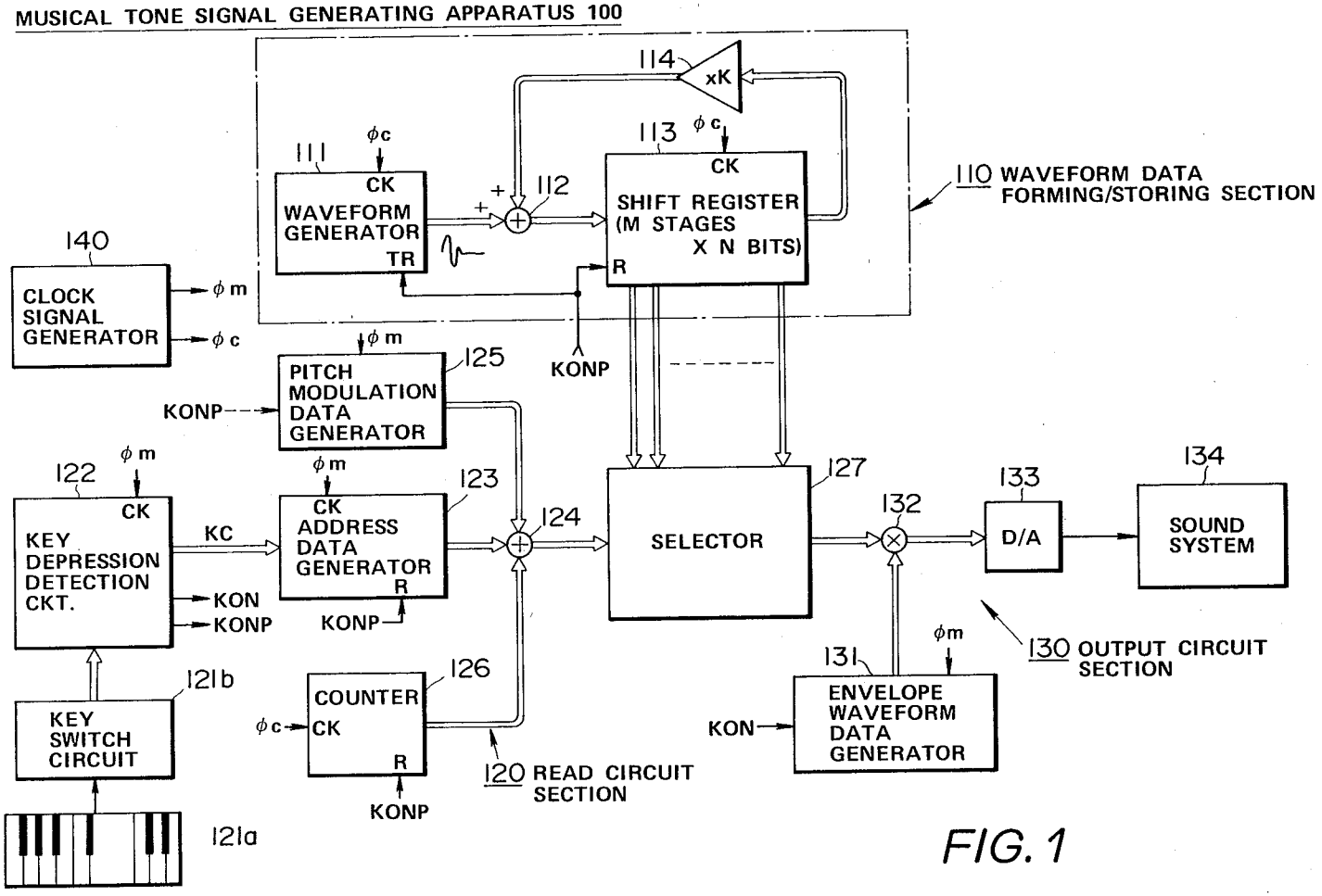
FIG. 1 is a block diagram of a musical tone signal generating apparatus 100 provided in accordance with the first embodiment of the present invention.

Referring now to FIG. 1, there is shown a musical tone signal generating apparatus 100 provided in accordance with a first embodiment of the present invention. The musical tone signal generating apparatus 100 generally comprises a waveform data forming-and-storing section 110 for forming and storing a group of waveform data representative of one cycle of musical tone waveform, a read circuit section 120 for reading the group of waveform data at a rate corresponding to a pitch of a key depressed on a keyboard 121*a*, and an output circuit section 130 for outputting a musical tone signal formed in accordance with the read waveform data. The waveform data forming-and-storing circuit 110, the read circuit section 120 and the output circuit section 130 operate in accordance with a master clock $\phi_m$ and (or) a tone color changing clock $\phi_c$ generated by a clock signal generator 140. A frequency of the tone color changing clock $\phi_c$ determines the changing rate of tone color of each musical tone generated, as later described, and is set to a value substantially lower than that of the master clock $\phi_m$.

The waveform data forming-and-storing section 110 comprises a waveform generator 111 which includes a memory storing a plurality of data previously obtained by sampling an original waveform. The waveform generator 111 is responsive to a key-on pulse KONP, which will be described later, to output the plurality of sampled data in synchronism with the tone color changing clock $\phi_c$. The sampled data thus outputted from the waveform generator 111 are sequentially supplied through an adder 112 to the first stage of a shift register 113. The aforesaid original waveform is an impulse response waveform such as one obtained when an object is struck. Such an impulse response waveform includes at the beginning many frequency components over a frequency range from the low frequency to the high frequency, and the amplitude and the high frequency components thereof gradually decrease with time. The shift register 113 comprises M (or $2^m$) stages of N-bit registers to store, in a recirculating fashion, the M pieces of N-bit sampled data representative of one cycle of the musical tone waveform. Each of the sampled data fed from the adder 112 and stored in the stage of the shift register 112 is shifted to the next lower stage in accordance with the tone color changing clock $\phi_c$. All the stages of the shift register 113 are cleared when the key-on pulse KONP is applied to a reset terminal R of the shift register 113. In this embodiment, M is set, for example, to "32" (or m="5"), and N is set, for example, to "10". All the stages of the shift register 113 output the N-bit sampled data contained therein in parallel to the read circuit section 120. The N-bit sampled data outputted from the last stage of the shift register 113 is also supplied to a multiplier 114 which multiplies the supplied sampled data by a gain coefficient K ($0<K\leqq 1$) and outputs the multiplication result to the adder 112. The adder 112 is connected at a first input terminal thereof to the output terminal of the waveform generator 111 and is connected at a second input terminal thereof to the output terminal of the multiplier 114. The adder 112 thus adds the two sampled data outputted from the waveform generator 111 and the multiplier 114 together and outputs the addition result to the first stage of the shift register 113. Thus, waveform data forming-and-storing section 110 effects an addition operation on the sampled data outputted from the waveform generator 111 by adding the output of the multiplier 114 to thereby cause the value of each of the M pieces of sampled data stored in the shift register 113 to change in synchronization with the tone color changing clock $\phi_c$. As a result, the waveform data representative of one cycle of the musical tone waveform changes every M cycles of the tone color changing clock $\phi_c$.

The read circuit section 120 comprises a key switch circuit 121*b*, which has a plurality of key switches corresponding respectively to the keys of the keyboard 121*a*, and a key depression detection circuit 122 which is electrically connected to the key switch circuit 121*b*. The key depression detection circuit 122 detects the current state (depressed state or released state) of each key of the keyboard 121*a* based on signals from the key switch circuit 121*b* and representative respectively of ON/OFF states of the key switches. The key depression detection circuit 122 then selects one of the depressed keys which is in a specific condition, that is, for example, the highest pitch key among the depressed keys, the lowest pitch key among the depressed keys or the earliest depressed key. The key depression detection circuit 122 outputs a key code KC representative of a name of the selected key to an address data generator 123. The key depression detection circuit 122 also outputs together with the key code KC a key-on signal KON representative of the depressed state of the selected key which is in the "1" state during the time when the selected key is kept depressed. The key depression detection circuit 122 further differentiates the key-on signal KON and outputs a key-on pulse KONP which becomes "1" for a short period of time from the leading edge of the key-on signal KON. The above operation of the key depression detection circuit 122 is effected in synchronization with the master clock $\phi_m$.

The address data generator 123 comprises a memory storing a plurality of data representative respectively of frequency numbers and an accumulator. The address data generator 123 reads, from the memory, one of the frequency number data of which value is proportional to the tone pitch corresponding to the key designated by the supplied key code KC. The accumulator is reset to "0" by the key-on pulse KONP and accumulates the read frequency number data at a constant interval determined by the master clock $\phi_m$. An output of this accumulator is supplied as address data to a first input terminal of an adder 124. Thus, the address data generator 123 outputs to the first input terminal of the adder 124 the address data which varies synchronously with the depression of the key and periodically at a rate proportional to the tone pitch corresponding to the key designated by the key code KC.

The adder 124 receives at a second input terminal thereof frequency changing data fed from a pitch modulation data generator 125 and also receives at a third input terminal thereof a count data fed from a counter 126. The adder 124 adds the address data from the address data generator 123, the frequency changing data from the pitch modulation data generator 125 and the count output of the counter 126 together, and outputs the higher-order m bits of the addition result to a selector 127 as selection control data. The pitch modulation data generator 125 is provided for imparting a vibrato effect to the generating musical tone, and outputs in synchronization with the master clock signal $\phi_m$ a plurality of frequency changing data whose values vary within a range between small positive and negative values at a low frequency. The counter 126 is composed of a m-bit counter which is reset to "0" by the key-on pulse KONP and counts pulses of the tone color changing clock signal $\phi_c$. The count output of the counter 126 therefore sequentially changes within the range of from "0" to "M−1" (or "$2^m-1$") in synchronization with the shift operation of the shift register 113. The selection control data outputted from the adder 124 also changes within the range of from "0" to "M−1", and the selector 127 selects, in accordance with the control data, one of the M pieces of sampled data which are fed from the stages of the shift register 113. It will be appreciated that the count output of the counter 126 causes the selection control data to change such that the shifting of the sampled data stored in the stages of the shift register 113 is canceled. Thus, the selection control data virtually selects the sampled data stored in the stages of the shift register 113 one by one in a sequential fashion or in a skip fashion, and such selection of sampled data is repeatedly performed. Consequently, the sampled data sequentially outputted from the selector 127 constitute digital musical tone waveform data which has a frequency determined by the address data from the address data generator 123 and corresponding to the tone pitch of the key depressed on the keyboard 121*a*, and is given the vibrato effect determined by the frequency changing data from the pitch modulation data generator 125.

The pitch modulation data generator 125 outputs, as described above, the low frequency signal data for imparting a vibrato effect to the musical tone. The pitch modulation data generator 125 may be modified so that the frequency changing data takes a small negative value immediately after a depression of key in response to the key-on pulse KONP and thereafter gradually decreases to zero taking alternately positive and negative values. The pitch modulation data generator 125 may alternatively be modified so that the frequency changing data takes small positive and negative values immediately after a depression of key in response to the key-on pulse KONP and thereafter gradually decreases to zero taking alternately positive and negative values. With these modified arrangements, the frequency changing data determined by the address data from the address data generator 123 are changed in accordance with the frequency changing data, so that a glide effect or an attack pitch effect can be imparted to the generating musical tone. The pitch modulation data generator 125 may also be modified so that the values of the frequency changing data are determined by the position of a pitch control knob on a control panel of an electronic musical instrument in which this apparatus 100 is provided. With this modified arrangement, the pitch of the generating musical tone can be shifted by an amount determined by the position of the knob.

The output circuit section 130 comprises an envelope waveform data generator 131 for giving a desired envelope to the digital musical waveform data outputted from the selector 127 and a multiplier 132. The envelope waveform data generator 131 generates in response to the key-on signal KONP a group of envelope waveform data which rise immediately after a depression of key, gradually decrease thereafter and abruptly decrease upon the release of the key. The envelope waveform data thus generated by the envelope waveform data generator 131 are supplied to the multiplier 132. As described earlier, the sampled data fed from the waveform data forming-and-storing section 110 decrease with the lapse of time, and therefore the rate of decrease of the envelope waveform data is determined taking into consideration such decrease of the sampled data. The multiplier 132 multiplies the digital musical tone waveform data from the selector 127 by the envelope waveform data to give a desired envelope to the musical tone to be generated. The digital musical waveform data thus given the envelope are supplied to a digital-to-analog converter (D/A converter) 133. The D/A converter 133 converts the digital musical tone waveform data into an analog signal and supplies this analog signal to a sound system 134 which comprises an amplifier and a loudspeaker, whereby a musical tone is outputted from the sound system 134.

The operation of this musical tone signal generating apparatus 100 will now be described.

When any one of the keys is depressed on the keyboard 121*a*, the key depression detection circuit 122 detects the depression of the key and outputs the key code KC, key-on signal KON and the key-on pulse KONP. The waveform generator 111 generates, in response to the key-on pulse KONP, the sampled waveform data which are then sequentially stored into the shift register 113. In parallel with this, the address data generator 123 outputs the address data which vary at a frequency proportional to the tone pitch of the depressed key. The address data generator 123 cooperates with the counter 126 to cause the selector 127 to sequentially and repeatedly output the plurality of sampled data in accordance with the address data, whereby the digital musical tone waveform data has a frequency corresponding to the tone pitch of the key depressed on the keyboard 121*a*. The digital musical waveform data thus produced are given a predetermined envelope by the envelope waveform data generator 131 and the multiplier 132, and are outputted through the D/A converter 133 to the sound system 134 as a musical tone signal.

On the other hand, during the time when the key is in the depressed state, the plurality of sampled waveform data stored in the shift register 113 when the key was depressed are sequentially supplied through the multiplier 114 to the adder 112 in synchronization with the tone color changing clock signal $\phi_c$. Each of the plurality of sampled waveform data thus supplied through the multiplier 114 is added to the corresponding sampled waveform data from the waveform generator 111 and stored into the shift register 113. As a result, each of the sampled waveform data in the shift register 113 is modified every M cycles of the tone color changing clock signal $\phi_c$. Thus, one cycle of musical tone waveform data which varies every M cycles of the tone color changing clock signal $\phi_c$ is obtained in the shift register 113. The musical tone waveform data thus varying with time are read, as described above, at a frequency corresponding to the tone pitch of the depressed key, given an envelope and outputted as a musical tone. Thus, the musical tone waveform data outputted from the selector 127 at the frequency corresponding to the tone pitch of the key depressed on the keyboard 121*a* are changed at a frequency determined by the tone color changing clock signal $\phi_c$ which is selected independently of the tone pitch. Therefore, the tone color of the musical tone outputted from the sound system 134 changes at a time interval independent of the pitch of the musical tone. Thus, the rate of change of tone color of the musical tone to be generated can be set to an appropriate value irrespectively of the change of pitch of the musical tone.

Since the high frequency components of the original waveform decrease with the lapse of time from the depression of key, the sampled waveform data in the shift register 113 are changed so that the high frequency components contained therein a lot when the key was depressed gradually decrease with the lapse of time.

When the depressed key is released, the envelope waveform data from the envelope waveform data generator 131 abruptly decrease and become zero, so that the output of the multiplier 132 also becomes zero. As a result, the generation of the musical tone by the sound system 134 ceases. In this embodiment, the musical tone waveform data outputted from the selector 127 decrease with the lapse of time from the depression of key, and the envelope waveform data outputted from the envelope waveform data generator 131 also decrease with the lapse of time from the depression of key, so that even when the same key continues to be depressed, the generation of the musical tone by the sound system 134 will cease when time of a certain length has elapsed.

When the pitch modulation data generator 125 is operated to add the frequency changing data to the address data from the address data generator 123, the pitch of the generating musical tone is changed by the frequency changing data. As a result, a musical effect such as a vibrato, a glide, an attack pitch, and a pitch control (or a pitch shift) is imparted to the generating musical tone, whereby the quality of the musical tone is improved.

A first modified form of the waveform data forming-and-storing section 110 will now be described.

Figure 2:
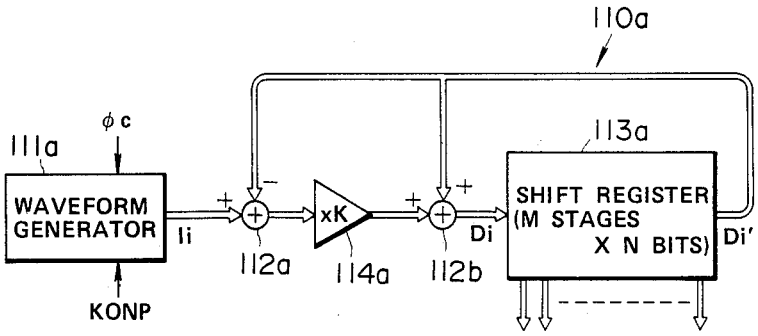
FIG. 2 is a block diagram of a first modified form 110*a* of the waveform data forming-and-storing section 110 of the musical tone signal generating apparatus 100 of FIG. 1.

FIG. 2 shows a modified waveform data forming-and-storing section 110*a*. This waveform data forming-and-storing section 110*a* comprises a waveform generator 111*a* and a shift register 113*a* which are identical in structure respectively to the waveform generator 111 and the shift register 113 of FIG. 1. Serially connected between the waveform generator 111*a* and the shift register 113*a* are a subtracter 112*a*, a multiplier 114*a* and an adder 112*b*. The subtracter 112*a* subtracts the sampled data outputted from the last stage of the shift register 113*a* from the sampled data outputted from the waveform generator 111*a*. The multiplier 114*a* multiplies the subtraction result outputted from the subtracter 112*a* by an amplification coefficient K ($0<K<1$). The adder 112*b* adds the sampled data outputted from the last stage of the shift register 113*a* to the multiplication result outputted from the multiplier 114*a*, and supplies the addition result to the first stage of the shift register 113*a*.

The sampled data $D_i$ supplied to the first stage of the shift register 113*a* by an operation circuit constituted by the subtracter 112*a*, multiplier 114*a* and adder 112*b* can be expressed as follows:

$$D_i = K\cdot(I_i - D_i') + D_i' \quad (1)$$

In the above equation (1), $I_i$ represents the sampled data outputted from the waveform generator 111*a*, and $D_i'$ represents the sampled data outputted from the last stage of the shift register 113*a*. Also, $D_i'$ represents the sampled data before operation, and $D_i$ represents the sampled data after operation. The above equation (1) can be modified to obtain:

$$D_i = K\cdot I_i + (1-K)\cdot D_i' \quad (2)$$

This equation (2) indicates that the sampled data stored in the shift register 113*a* (i.e., the musical tone waveform data) are gradually changed by the sampled data outputted from the waveform generator 111*a*. Thus, this modified waveform data forming-and-storing section 110*a* functions similarly to the waveform data forming-and-storing section 110 of FIG. 1. With the first modified waveform data forming-and-storing section 110*a*, the amplification coefficients for the sampled data $I_i$ and $D_i'$ are K and $(1-K)$, respectively, as will be appreciated from the above equation (2). Therefore, the change of level of the sampled data $D_i$ supplied to the first stage of the shift register 113*a* is small relatively to that of the sampled data supplied to the first stage of the shift register 113 of FIG. 1 even when the amplification coefficient is changed, for example, in accordance with a tone color selection signal outputted from an associated tone color selection switch (not shown), the key code KC outputted from the key depression detection circuit 122, or the lapse of time from the depression of key.

A second modified form of the waveform data forming-and-storing section 110 will now be described.

Figure 3:
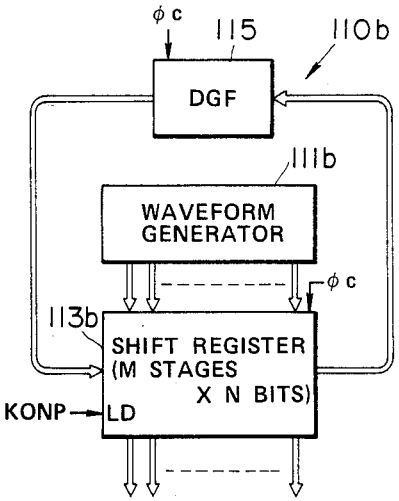
FIG. 3 is a second modified form 110*b* of the waveform data forming-and-storing section 110 of the musical tone signal generating apparatus 100 of FIG. 1.

FIG. 3 is a block diagram of the second modified form 110*b* of the waveform data forming-and-storing section 110. The waveform data forming-and-storing section 110*b* comprises a waveform generator 111*b*, a shift register 113*b*, and a digital filter (DGF) 115. The waveform generator 111*b* comprises a memory storing M pieces of sampled data of a waveform containing many high-frequency components such as a square wave, a saw-tooth wave, a triangular wave and a random wave (a wave obtained by randomly arranging the sampled data). The waveform generator 111*b* outputs the M pieces of sampled data in parallel to the shift register 113*b*, the M pieces of sampled data representing one cycle of the sampled waveform. The shift register 113*b* has M stages of N-bit registers, similarly to the shift register 113 of FIG. 1, and stores the sampled data of one cycle of the waveform by shifting the sampled data in a recirculating fashion in accordance with the tone color changing clock signal $\phi_c$. The shift register 113*b* outputs from each of the stages thereof the N-bit sampled data. When the key-on pulse KONP is generated, the shift register 113*b* stores all the sampled data fed from the waveform generator 111*b* in parallel for providing initial data. The digital filter 110*b* is constituted, for example, by a low-pass filter, and provided in the feedback path for the shift register 113*b*. The digital filter 115 is controlled by the tone color changing clock signal $\phi_c$, and causes the sampled data stored in the shift register 113*b* to be changed with the lapse of time in synchronization with the shift operation of the shift register 113*b*.

With the arrangement of the waveform data forming-and-storing section 110*b*, the sampled data of the waveform which includes many high-frequency components are transferred from the waveform generator 111*b* to the shift register 113*b* simultaneously with the depression of key. Thereafter, the sampled data stored in the shift register 113*b* are modified by the digital filter 115 in synchronization with the shift operation of the shift register 113*b*, whereby the sampled data are gradually changed to those of a waveform having a fewer high-frequency components. Thus, the second modified waveform data forming-and-storing section 110*b* has the same effect as that of the waveform data forming-and-storing section 110 in which the sampled data are gradually changed in synchronization with the tone color changing clock signal $\phi_c$.

A modified form of the selector 127 of FIG. 1 will now be described.

Figure 4:
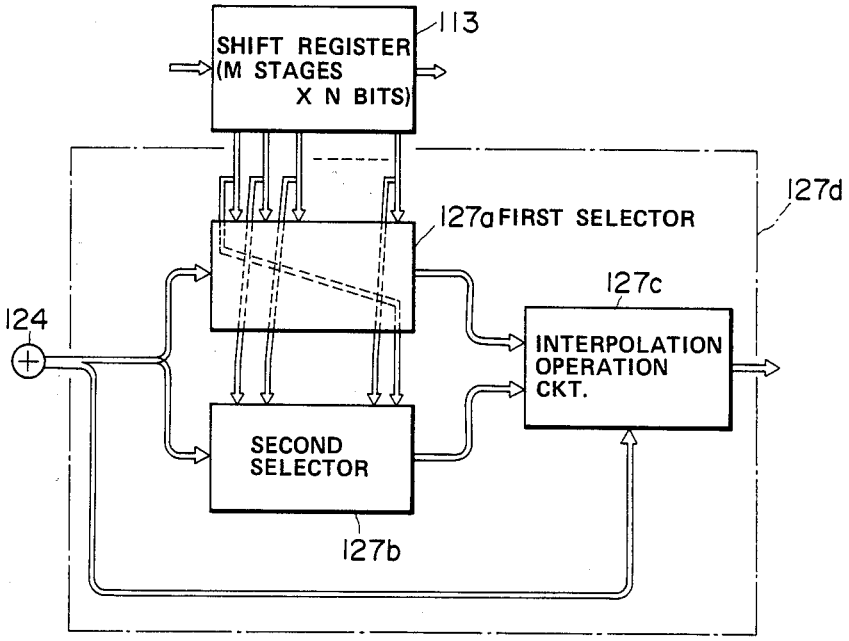
FIG. 4 is a block diagram of a modified form 127*d* of the selector 127 of the musical tone signal generating apparatus 100 of FIG. 1.

FIG. 4 shows the modified selector 127*d* which is so arranged that an output thereof is obtained by effecting an interpolation operation on more than one sampled data from the shift register 113. The modified selector 127*d* comprises a first selector 127*a*, a second selector 127*b* and an interpolation operation circuit 127*c*, the first and second selectors 127*a* and 127*b* being identical in structure to the selector 127 of FIG. 1. This selector 127*d* receives from the adder 124 the selection control data each of which is composed, in this case, of more than m bits. The higher-order m bits of the selection control data are supplied to the first and second selectors 127*a* and 127*b*, while the remaining bits of the selection control data are supplied to the interpolation operation circuit 127*c*. The higher-order m bits of the selection control data correspond to the selection control data supplied to the selector 127 of FIG. 1.

The first to Mth data input terminals of the first selector 127*a* are supplied respectively with the sampled data outputted from the first to Mth stages of the shift register 113, as is the case with the selector 127 of FIG. 1. The first to Mth data input terminals of the second selector 127*b* are supplied respectively with the sampled data outputted from the second to Mth and first stages of the shift register 113, that is, from those stages one stage higher than the corresponding stages. It should be noted that the (M+1)th stage of the shift register 113 is the first stage thereof. Thus, when the m-bit selection control data supplied to the first and second selectors 127*a* and 127*b* represents "J" ("J" is an integer between "0" and "M−1"), the first selector 127*a* outputs the sampled data fed from the (J+1)th stage of the shift register 113, and the second selector 127*b* outputs the sampled data fed from the (J+2)th stage of the shift register 113. "J+1" representative of "M+1" is equal to "1". The interpolation operation circuit 127*c* receives the two sampled data, which have been adjacent to each other in the shift register 113, from the first and second selectors 127*a* and 127*b*, and interpolates the two sampled data in accordance with the lower-order bits of the selection control data. The result of the interpolation is outputted from the interpolation operation circuit 127*c* to the multiplier 132 of FIG. 1.

With this arrangement, each pair of sampled data adjacent to each other is interpolated, so that the digital musical tone waveform varies smoothly.

A second embodiment of the invention will now be described.

Figure 5:
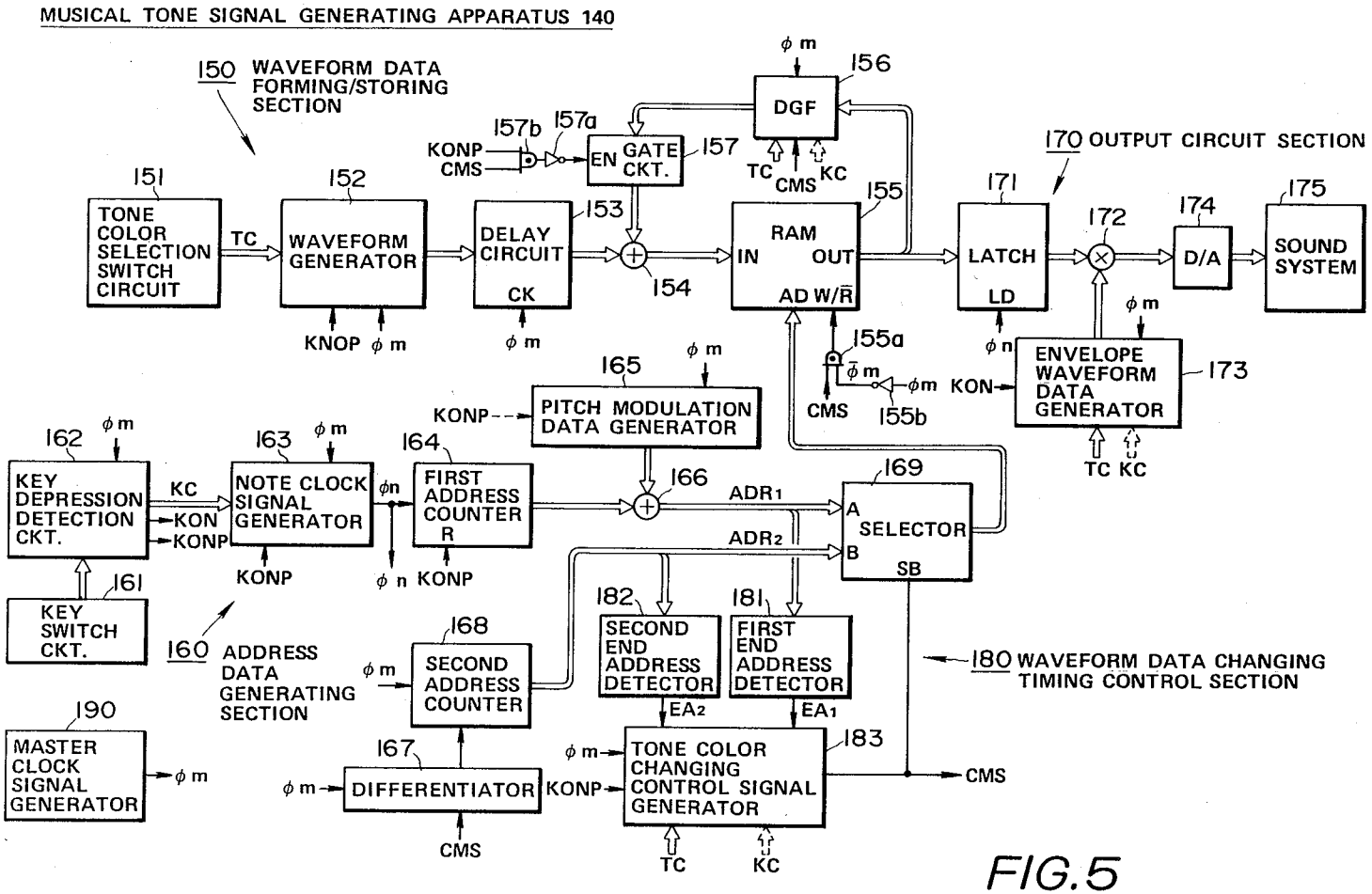
FIG. 5 is a musical tone signal generating apparatus 140 provided in accordance with a second embodiment of the present invention.

FIG. 5 shows a musical tone signal generating apparatus 140 provided in accordance with the second embodiment of the invention. This musical tone signal generating apparatus 140 is arranged such that storage means for storing waveform data representative of one cycle of musical tone waveform is constituted by a memory (or RAM) into any address of which data can be written by designating the address by address data. The musical tone signal generating apparatus 140 comprises a waveform data forming-and-storing section 150 for forming and storing a group of data representative of one cycle of musical tone waveform, and address data generating section 160 for generating address data to control the writing and reading of the waveform data with respect to the waveform data forming-and-storing section 150. The musical tone signal generating apparatus 140 further comprises an output circuit section 170 for outputting a musical tone signal in accordance with the waveform data read from the waveform data forming-and-storing section 150, and a waveform data changing timing control section 180 for controlling each changing timing of the waveform data stored in the waveform data forming-and-storing section 150. The above four sections 150 160, 170 and 180 are controlled in accordance with a master clock signal $\phi_m$ outputted from a master clock signal generator 190.

The waveform data forming-and-storing section 150 includes a tone color selection switch circuit 151 for selecting a tone color of the musical tone to be generated. The tone color selection switch circuit 151 comprises a plurality of tone color selection switches to be operated by the performer, and outputs to a waveform generator 152 tone color selection data TC indicative of a tone color of the musical tone to be generated, in response to the ON/OFF states of the tone color selection switches. The waveform generator 152 comprises a memory storing a plurality of groups of waveform data each group representing a waveform which contains many high-frequency components such as a square wave, a saw-tooth wave, a triangular wave and a random wave. The waveform generator 152 selects one of the plurality of groups of waveform data in accordance with the tone color selection data TC, and begins to output the selected waveform data when a key-on pulse signal KONP, which will be described later, is generated. The waveform data of the selected group are composed of M (or $2^m$) pieces of sampled data obtained by sampling one cycle of the corresponding musical tone waveform, as those stored in the memory of the waveform generator 111*b* of FIG. 3. Each of the sampled data outputted from the waveform generator 152 is supplied to a delay circuit 153 in synchronization with the master clock signal $\phi_m$. The delay circuit 153 is responsive to the master clock signal $\phi_m$ in the "1" state to store the supplied data thereinto and output the delayed data. Thus, the delay circuit 153 delays the sampled data fed from the waveform generator 152 by one cycle of the master clock signal $\phi_m$ and outputs the delayed sampled data through an adder 154 to a RAM 155 in synchronization with the leading edge of the master clock signal $\phi_m$.

The RAM 155 is provided for storing respectively into different addresses thereof the supplied M pieces of sampled data which constitute the waveform data representative of one cycle of the waveform. The RAM 155 has a data input terminal IN connected to the adder 154 for receiving the sampled data from the adder 154, and a data output terminal OUT for outputting the stored sampled data. The RAM 155 also has an address data input terminal AD for receiving address data indicating an address thereof into which the supplied sampled data is to be written, and a mode selection terminal W/R for receiving a mode selection signal which selects one of data write mode and data read mode of the RAM 155. When the mode selection signal is "0" the RAM 155 selects the data read mode, and when the mode selection signal is "1" the RAM 155 selects the data write mode. The mode selection signal is supplied to the RAM 155 from an AND gate 155*a*. The AND gate 155*a* inputs a tone color changing control signal CMS fed from the waveform data changing timing control section 180 and an inverted master clock signal $\phi_m$ fed from an inverter for inverting the master clock signal $\phi_m$. The AND gate 155*a* renders the mode selection signal "1" when both input signals CMS and $\phi_m$ are "1". Therefore, the RAM 155 is held in the data read mode when the tone color changing control signal CMS is "0". On the other hand, where the tone color changing control signal CMS is "1", the RAM 155 is held in the data read mode when the inverted master clock signal $\phi_m$ is "0" and is held in the data write mode when the inverted master clock signal $\phi_m$ is "1".

Figure 6:
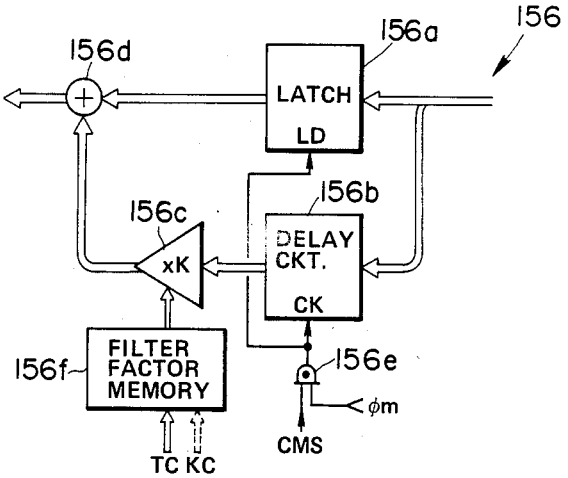
FIG. 6 is a detailed logic block diagram of the digital filter 156 of the musical tone signal generating apparatus 140 of FIG. 5.

The data output terminal OUT of the RAM 155 is connected through a digital filter (DGF) 156 and a gate circuit 157 to the adder 154. As shown in detail in FIG. 6, the digital filter 156 is composed of a low-pass filter which comprises a latch 156*a*, a delay circuit 156*b*, a multiplier 156*c* and an adder 156*d*. The latch 156*a* stores the data from the data output terminal OUT of the RAM 155 in response to a "1" signal fed from an AND gate 156*e*. In this case, the latch 156*a* outputs the data stored thereinto simultaneously with the storing of the same data. The AND gate 156*e* inputs the tone color changing control signal CMS and the master clock signal $\phi_m$, and outputs the "1" signal when both signals are "1". Therefore, when the tone color changing control signal CMS is in the "1" state, the latch 156*a* stores and outputs the sampled data read from the RAM 155 each time the master clock signal $\phi_m$ changes from "0" to "1". The delay circuit 156*b* comprises a register which is responsive to the output signal of the AND gate 156*e* in the "1" state to store the input data and output the delayed data. When the tone color changing control signal CMS is in the "1" state, the delay circuit 156*b* delays the sampled data fed from the RAM 155 by a time period equivalent to one cycle of the master clock $\phi_m$ and outputs the delayed sampled data to the multiplier 156*c* in synchronization with the leading edges of the master clock signal $\phi_m$. In this case, the sampled data stored into the delay circuit 156*b* immediately before the tone color changing control signal CMS changes from "1" to "0" is held in the delay circuit 156*b* until the tone color changing control signal CMS is again rendered "1". The multiplier 156*c* multiplies the sampled data fed from the delay circuit 156*b* by a coefficient K and outputs the multiplication result. A filter factor memory 156*f* stores therein a plurality of filter factors, selects one of the stored filter factors in accordance with the tone color selection data TC, and outputs the selected filter factor as the coefficient K to the multiplier 156*c*. The filter factor memory 156*f* may be modified to input a key code KC in addition to the tone color selection data TC so that the value of the selected filter factor is changed in accordance with a pitch of the generating musical tone. The adder 156*d* adds both sampled data fed respectively from the latch 156*a* and the multiplier 156*c* together, and outputs sampled data representative of the result of the addition to the gate circuit 157 (FIG. 5).

The gate circuit 157 controls the feeding of the sampled data from the digital filter 156 to the adder 154. The gate circuit 157 allows the sampled data to be fed from the digital filter 156 to the adder 154 when a control signal in the "1" state is supplied to an enable terminal EN thereof, and prevents the sampled data from being fed from the digital filter 156 to the adder 154 when the control signal fed to the enable terminal EN is "0". Connected through an inverter 157*a* to the enable terminal EN of the gate circuit 157 is an output terminal of an AND gate 157*b* which inputs the key-on pulse KONP and the tone color changing control signal CMS. Thus, the feeding of the sampled data from the digital filter 156 to the adder 154 is prevented only when both of the key-on pulse KONP and the tone color changing control signal CMS are "1", and the feeding of the sampled data is allowed otherwise.

The address data generating section 160 comprises a first address data generating section which generates first address data ADR1 for designating addresses of the RAM 155 from which the sampled data are read in order to form a musical tone. The first address data generating section comprises a key switch circuit 161, a key depression detection circuit 162, a note clock signal generator 163, a first address counter 164, a pitch modulation data generator 165, and an adder 166. The address data generating section 160 also comprises a second address data generating section which generates second address data ADR2 for designating addresses of the RAM 155 which the sampled data are read from or stored into to modify the sampled data stored in those addresses. The second address generating section includes a differentiator 167 and a second address counter 168. The address data generating section 160 further comprises a selector 169 for selectively outputting the first address data ADR1 and the second address data ADR2 to the RAM 155.

The key switch circuit 161 and the key depression detection circuit 162 are the same in structure as those shown in FIG. 1, and the key depression detection circuit 162 outputs a key code KC, a key-on signal KON and a key-on pulse KONP (see FIG. 8) which are similar to those generated by the key depression detection circuit 122 of FIG. 1. The note clock signal generator 163 comprises a frequency division rate memory (not shown) having a plurality of addresses for respectively storing a plurality of frequency division rate data. One of the addresses is accessed by the key code KC to read therefrom the frequency division rate data representative of a frequency division rate inversely proportional to a tone pitch of the key designated by the key code KC. The note clock signal generator 163 further comprises a variable-type frequency divider which divides the frequency of the master clock signal $\phi_m$ at the rate determined by the read frequency division rate data to output a frequency-divided signal $\phi_n$. This frequency divider is reset by the key-on pulse KONP. Thus, the note clock signal generator 163 outputs from the frequency divider the frequency-divided signal $\phi_n$ as a note clock signal (FIG. 9) which is produced in synchronization with a depression of key on an associated keyboard (not shown in FIG. 5) and has a frequency proportional to the tone pitch of the depressed key. The first address counter 164 is composed of an m-bit counter for counting pulses of the note clock signal $\phi_n$ which is reset to zero by the key-on pulse KONP. The count output of the first address counter 164 varies within the range of between "0" and "M−1" in synchronization with a depression of key on the keyboard at a rate proportional to the tone pitch of the depressed key. The pitch modulation data generator 165 is identical in construction to the pitch modulation data generator 125 of FIG. 1, and outputs a frequency changing data similar to that outputted from the pitch modulation data generator 125 of FIG. 1. The adder 166 adds the the count output of the first address counter 164 and the frequency changing data from the pitch modulation data generator 165 together, and outputs the higher-order m bits of the result of the addition to the selector 169 as the first address data ADR1. Therefore, the first address data ADR1 sequentially changes within the range of between "0" and "M−1" (where M is $2^m$) at a rate proportional to a frequency obtained by modulating (or shifting) the tone pitch of the depressed key by the frequency changing data (see FIG. 9).

The differentiator 167 differentiates the tone color changing control signal CMS to output at the leading edge thereof a pulse signal synchronized with the master clock signal $\phi_m$ and having a pulse width equal to the period of the master clock signal $\phi_m$. The pulse signal thus outputted from the differentiator 167 is supplied to the second address counter 168 as a reset signal. The second address counter 168 is composed of an m-bit counter which is reset by the pulse signal from the differentiator 167 and counts pulses of the master clock signal $\phi_m$ to provide a count output which is within the range of between "0" and "M−1" (M $=2^m$) and is incremented by one each time the master clock signal $\phi_m$ changes from "0" to "1". Thus, the second address data ADR2 is sequentially changed within the range of between "0" and "M−1" in response to each cycle of the master clock signal $\phi_m$.

The selector 169 receives the first address data ADR1 at a first input terminal A thereof and receives the second address data ADR2 at a second input terminal B thereof. The selector 169 outputs the first address data ADR1 to an address terminal AD of the RAM 155 when the tone color changing control signal CMS is in the "0" state, and outputs the second address data ADR2 to the address terminal AD when the signal CMS is in the "1" state.

The output circuit section 170 comprises a latch 171 connected to the data output terminal OUT of the RAM 155. The latch 171 stores the sampled data from the RAM 155 in response to each pulse of the note clock signal $\phi_n$ from the note clock signal generator 163, and at the same time outputs the stored sampled data to a multiplier 172 as digital musical tone waveform data. The storing of the sampled data into the latch 171 is effected in synchronization with the change of the first address data ADR1. From this fact, it will be appreciated that the sampled data read from the RAM 155 in accordance with the addressing by the first address data ADR1 is stored into the latch 171 when the first address data ADR1 is changed. The digital musical tone waveform data supplied to the multiplier 172 is given a desired envelope based on envelope waveform data outputted from an envelope waveform data generator 173, as described above for the first embodiment. The digital musical tone waveform data thus given the envelope is converted by a D/A converter 174 into an analog signal which is supplied to a sound system 175, whereby a musical tone is produced. In this case, the envelope waveform data generator 173 selectively outputs various envelope waveform data in accordance with the tone color selection data TC and (or) the key code KC.

The waveform data changing timing control section 180 is provided for outputting the tone color changing control signal CMS which controls the timing of modification of each sampled data in the RAM 155 in order to change, with time, the tone color of the generating musical tone. The waveform data changing timing control section 180 comprises a first end address detector 181, a second end address detector 182 and a tone color changing control signal generator 183. The first end address detector 181 receives the first address data ADR1, and outputs to the tone color changing control signal generator 183 a first end address detection signal EA1 which becomes "1" when the first address data ADR1 represents the end address "M−1" (or "$2^m-1$") of the RAM 155, and otherwise becomes "0". Similarly, the second end address detector 182 receives the second address data ADR2, and outputs to the tone color changing control signal generator 183 a second end address detection signal EA2 which becomes "1" when the second address data ADR2 represents the end address "M−1" (or "$2^m-1$") of the RAM 155, and otherwise becomes "0".

Figure 7:
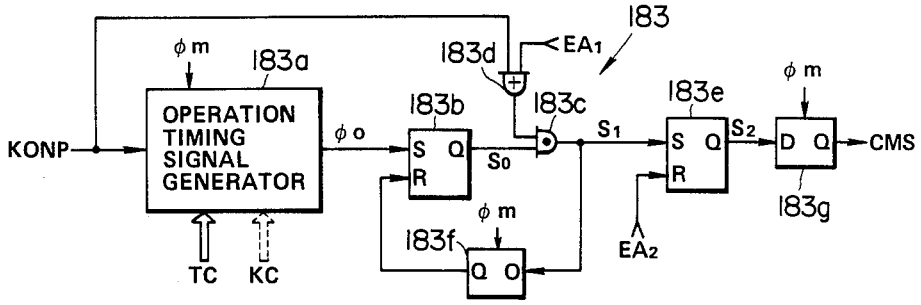
FIG. 7 is a detailed logic block diagram of the tone color changing control signal generator 183 of the musical tone signal generating apparatus 140 of FIG. 5.

As shown in detail in FIG. 7, the tone color changing control signal generator 183 comprises an operation timing signal generator **183*a*. The operation timing signal generator 183*a* is composed of a variable-type frequency divider which divides the frequency of the master clock signal $\phi_m$ by a frequency division rate determined by the tone color selection data TC. The frequency divider outputs a pulse simultaneously with the input of the key-on pulse KONP and, thereafter, repeatedly outputs pulses at an interval determined by the frequency division rate. These pulses outputted from the frequency divider are supplied as an operation timing signal $\phi_o$ (FIG. 8) to a set terminal S of a flip-flop 183*b*, whereby the flip-flop 183*b* is set. The operation timing signal $\phi_o$ is synchronized with the leading edges of the master clock signal $\phi_m$ and has a pulse width equal to one cycle of the master clock signal $\phi_m$. A signal $S_0$ outputted from the Q terminal of the flip-flop 183*b* thus set to "1" is supplied to one input terminal of an AND gate 183*c*. The other input terminal of the AND gate 183*c* is supplied with an output of an OR gate 183*d* whose input terminals are supplied respectively with the first end address detection signal EA1 and the key-on pulse KONP. A signal $S_1$ outputted from the AND gate 183*c* is supplied to a set terminal S of another flip-flop 183*e* and is supplied through a delay circuit 183*f* to a reset terminal R of the flip-flop 183*b*. The delay circuit 183*f* is responsive to the master clock signal $\phi_m$ to delay the signal $S_1$ fed from the AND gate 183*c* by a time period equal to one cycle of the master clock signal $\phi_m$. Once the flip-flop 183*b* is set by the operation timing signal $\phi_o$, the signal $S_1$ is rendered "1" when either of the key-on pulse KONP or the first end address detection signal EA1 becomes "1". However, since the flip-flop 183*b* is reset by the signal $S_1$ supplied through the delay circuit 183*f*, the signal $S_1$ supplied to the set terminal of the flip-flop 183*e*** becomes a pulse signal which rises at the leading edge of the key-on pulse KONP or the first end address detection signal EA1 and has a pulse width equal to the period of the master clock signal $\phi_m$.

A reset terminal R of the flip-flop **183*e* is supplied with the second end address detection signal EA2, so that the flip-flop 183*e* outputs to a delay circuit 183*g* a signal $S_2$ which rises from "0" to "1" when the signal $S_1$ becomes "1" and falls from "1" to "0" when the second end address detection signal EA2 is generated. The delay circuit 183*g*** is controlled by the master clock signal $\phi_m$ to delay the signal $S_2$ by a time period equal to one cycle of the master clock signal $\phi_m$, and outputs the delayed signal $S_2$ as the tone color changing control signal CMS.

With the above arrangement, the period of the operation timing control signal $\phi_o$ generated by the operation timing signal generator **183*a* is determined solely by the tone color selection data TC. The operation timing signal generator 183*a* may be modified to further input the key code KC so that the period of the operation timing signal $\phi_o$ is determined by both of the tone color selected by the tone color selection switch circuit 151** and the tone pitch of the key depressed on the keyboard. The operation timing signal $\phi_o$ is not necessarily be a pulse signal of a constant time interval, and may be such a pulse signal whose time interval is changed with the time elapsed from the depression of key.

The operation of the musical tone generating apparatus 140 will now be described with reference to timing charts shown in FIGS. 8 to 11. The following description is divided into two parts wherein the operation of the apparatus 140 during a first time period immediately after a key depression is described in the first part and that during a second time period after the first time period is described in the second part.

(1) Operation during first time period immediately after key depression

Figure 8:
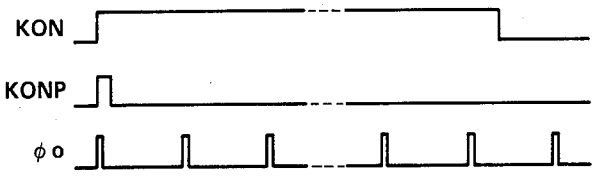
FIG. 8 is a timing chart of signals KON, KONP and $\phi_o$ appearing in the musical tone signal generating apparatus 140 of FIG. 5.

When one of the keys is depressed on the keyboard, the key depression detection circuit 162 (FIG. 5) outputs, in response to the key depression, the key-on signal KON and the key-on pulse signal KONP both shown in FIG. 8. In response to the key-on pulse KONP thus generated, the tone color changing control signal generator 183 outputs the tone color changing control signal CMS which is rendered "1" in the following manner.

Figure 10:
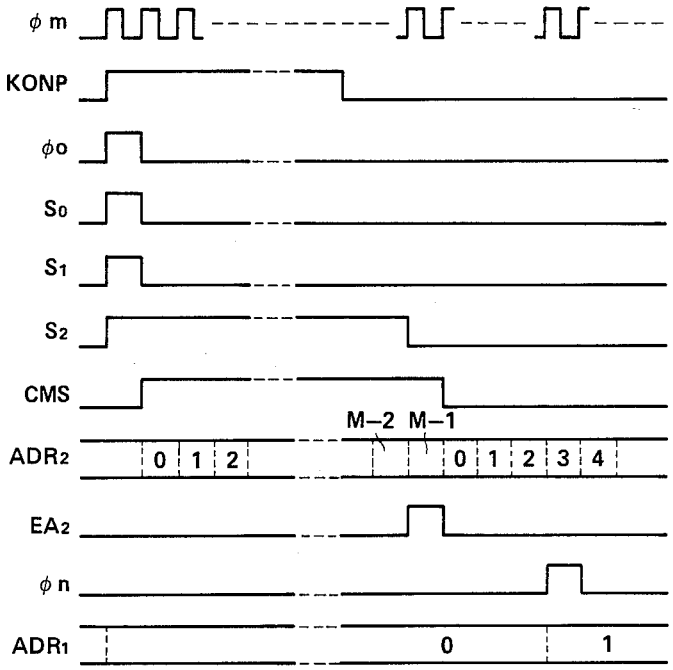
FIG. 10 is a timing chart of various signals appearing in the musical tone signal generating apparatus 140 of FIG. 5 during a first time period immediately after a key depression.

The operation timing signal generator 183*a* (FIG. 7) in the tone color changing control signal generator 183 generates, in response to the key-on pulse KONP, the operation timing signal $\phi_o$ which is rendered "1" at the leading edge of the key-on pulse KONP and has a pulse width equal to the period of the master clock signal $\phi_m$, as shown in FIG. 10. The flip-flop 183*b* is set by the operation timing signal $\phi_o$, so that the output signal $S_0$ of the flip -flop 183*b* is rendered "1" and supplied to the one input terminal of the AND gate 183*c*. At this time, the other input terminal of the AND gate 183*c* is supplied through the OR gate 183*d* with the key-on pulse KONP at the "1" level, so that the output signal $S_1$ of the AND gate 183*c* becomes "1". The flip-flop 183*e* is set by the signal $S_1$ thus rendered "1" and outputs the signal $S_2$ at the "1" level which is delayed by the delay circuit 183*g* by one cycle time of the master clock signal $\phi_m$ and outputted as the tone color changing control signal CMS. In this case, since the signal $S_1$ is delayed by the delay circuit 183*f* by one clock time of the master clock signal $\phi_m$ and fed to the flip-flop 183*b* to reset it, the signals $S_0$ and $S_1$ fall to "0" when a time period equal to one cycle of the master clock signal $\phi_m$ has elapsed from the leading edges of the signals $S_0$ and $S_1$. As a result, the signals $S_0$ and $S_1$ respectively become pulse signals each of which rises to "1" at the leading edge of the key-on pulse KONP and has a pulse width equal to one clock time of the master clock signal $\phi_m$, and the signal $S_2$ rises at the leading edge of the key-on pulse KONP and maintains the "1" level thereafter, as shown in FIG. 10. The tone color changing control signal CMS rises to "1" one clock time of the master clock signal $\phi_m$ after the leading edge of the key-on pulse KONP and maintains the "1" level thereafter.

On the other hand, the second address counter 168 (FIG. 5) is reset by the output of the differentiator 167 at the leading edge of the tone color changing control signal CMS and begins to count the pulses of the master clock signal $\phi_m$. Therefore, the second address data ADR2 sequentially changes from "0" to "M−1 in synchronization with the master clock signal $\phi_m$ from the leading edge of the tone color changing control signal CMS, and repeats such changing. When the second address data ADR2 becomes equal to "M−1", the second end address detector 182 outputs the second end address detection signal EA2, as shown in FIG. 10. The second end address detection signal EA2 is supplied to the flip-flop 183*e* *(FIG. 7) isn the tone color changing control signal generator 183, so that the flip-flop 183e* is reset at the leading edge of the second end address detection signal EA2. As a result, the signal $S_2$ which has been at the "1" level is rendered "0" at the leading edge of the second end address detection signal EA2, as shown in FIG. 10. In addition, the tone color changing control signal CMS which has been at the "1" level is rendered "0" one clock time of the master clock signal $\phi_m$ after the trailing edge of the signal $S_2$. The tone color changing control signal CMS is supplied to the selector 169 (FIG. 5), so that the selector 169 outputs the second address data ADR2 to the address data input terminal AD of the RAM 155 during the time when the tone color changing control signal CMS is "1". Thus, during the time when the tone color changing control signal CMS is at the "1" level the addresses "0" to "M−1" of the RAM 155 are sequentially accessed in synchronization with the master clock signal $\phi_m$.

At this time, the gate circuit 157 is in the closed state since both of the key-on pulse KONP and the tone color changing control signal CMS are "1", so that the sampled data outputted from the digital filter 156 is prevented from being supplied to the adder 154. As a result, the adder 154 are supplied only with the M pieces of sampled data from the waveform generator 152, the sampled data containing many high-frequency components. The sampled data supplied to the adder 154 are those generated by the waveform generator 152 in synchronism with the M pieces of pulses of the master clock signal $\phi_m$ from the leading edge of the key-on pulse KONP and delayed by the delay circuit 153 by one clock time of the master clock signal $\phi_m$. Therefore, during the time when the tone color changing control signal CMS, which rises to "1" one clock time of the master clock signal $\phi_m$ after the leading edge of the key-on pulse KONP, is at the "1" level, the aforesaid M pieces of sampled data are sequentially supplied to the data input terminal IN of the RAM 155 in synchronism with the master clock signal $\phi_m$.

Furthermore, during the time when the tone color changing control signal CMS is at the "1" level, the mode selection terminal $W/\overline{R}$ of the RAM 155 is supplied from the AND gate 155*a* with a signal which is rendered "1" to bring the RAM 155 into the write mode each time the inverted clock signal $\phi_m$ becomes "1". Therefore, the aforesaid M pieces of sampled data generated by the waveform generator 152 are sequentially written into the addresses "0" to "M−1" of the RAM 155.

Figure 9:
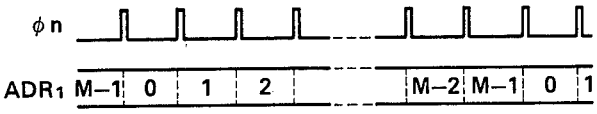
FIG. 9 is a timing chart showing the relation between a note clock signal $\phi_n$ and first address data ADR1 appearing in the musical tone signal generating apparatus 140 of FIG. 5.

When the tone color changing control signal CMS is rendered "0" after the writing of the M pieces of sampled data into the RAM 155 has completed, the selector 169 outputs the first address data ADR1 to the address data input terminal AD of the RAM 155. The first address data ADR1 represents a value substantially equal to the count value contained in the first address counter 164 (strictly speaking, slightly shifted from the value by the frequency changing data generated by the pitch modulation data generator 165). Since the first address counter 164 is reset by the key-on pulse KONP and begins to count the pulses of the note clock signal $\phi_n$, the value of the first address data ADR1 changes from "0" to "1" at the leading edge of the first pulse of the note clock signal $\phi_n$ generated after the generation of the key-on pulse KONP, as shown in FIG. 10. Thereafter, the first address data ADR1 is incremented by one each time the note clock signal $\phi_n$ becomes "1" and repeatedly varies from "0" to "M−1", as shown in FIG. 9. As a result, the address "0" to "M−1" of the RAM 155 are sequentially accessed. At this time, the tone color changing control signal CMS is at the "0" level, so that the mode selection terminal W/$\overline{R}$ of the RAM 155 is supplied with a "0" signal which holds the RAM 155 in the read mode. Consequently, the sampled data is read from the address of the RAM 155 designated by the first address data ADR1. In this manner, the sampled data transferred from the waveform generator 152 to the RAM 155 are sequentially read from the RAM 155. Each of the sampled data thus read from the RAM 155 is stored in the latch 171, which is responsive to the note clock signal $\phi_n$, and thence supplied through the multiplier 172 and the D/A converter 174 to the sound system 175 in a manner described above for the apparatus 100, whereby a musical tone given a desired envelope is produced.

It will be appreciated from the foregoing that immediately after a key is newly depressed on the keyboard the waveform data (sampled data) outputted from the waveform generator 152 and including many high-frequency components is transferred to the RAM 155. The sampled data are thereafter sequentially and repeatedly read from the RAM 155 at a rate corresponding to the tone pitch of the depressed key to form a musical tone. The musical tone generated therefore contains many high-frequency components. The note clock signal $\phi_n$ is not supplied to the latch 171 at the instant of the depression of the key, so that the sampled data in the address "0" of the RAM 155 is not supplied to the multiplier 172 during the first read cycle of the "M" pieces of sampled data after the depression of the key. However, this does not give any adverse acoustic effects on the musical tone generated since the period of the note clock signal $\phi_n$ is short.

(2) Operation during second time period after first time period

Figure 11:
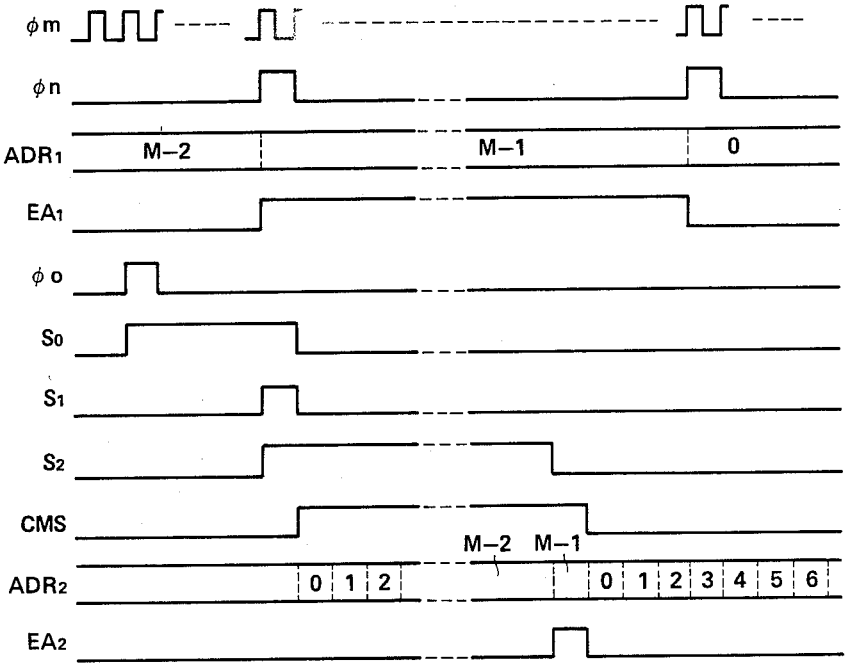
FIG. 11 is a timing chart of various signals appearing in the musical tone signal generating apparatus 140 of FIG. 5 during a second time period after the first time period.

When the operating timing signal $\phi_o$ outputted from the operation timing signal generator 183*a* in the tone color changing control signal generator 183 (FIGS. 5 and 7) rises from "0" to "1" as shown in FIG. 11 during the time when the sampled data are sequentially read from the RAM 155 as described above, the flip-flop 183*b* is set, so that the output signal $S_0$ thereof rises from "0" to "1" at the leading edge of the operation timing signal $\phi_o$ (see FIG. 11). However, since the key-on pulse KONP fed through the OR gate 183*d* to the AND gate 183*c* is at the "0" level at this time, the signal $S_1$ is held in the "0" state so long as the first end address detection signal EA1 is "0" (FIG. 11). The flip-flop 183*e* is kept reset since the signal $S_1$ is thus "0", so that the signal $S_2$ and the tone color changing control signal CMS are both held in the "0" state. In this condition, the addresses of the RAM 155 are accessed by the first address data ADR1, and the sampled data are sequentially read from the RAM 155 in synchronization with the note clock signal $\phi_n$ and fed through the latch 171 to the multiplier 172, as described above for the case (1).

When the first address data ADR1 reaches the value "M−1" representative of the end address of the RAM 155 as the result of the increase of the count output of the first address counter 164 for counting the pulses of the note clock signal $\phi_n$, the first end address detection signal EA1 outputted from the first end address detector 181 rises from "0" to "1", as shown in FIG. 11. As a result, the signal $S_1$ is rendered "1" and is then rendered "0" after one clock time of the master clock signal $\phi_m$. In parallel with this, the signal $S_2$ is rendered "1" at the leading edge of the signal $S_1$, and the tone color changing control signal CMS is rendered "1" one clock time of the master clock signal $\phi_m$ after the leading edge of the signal $S_2$. Thus, when the first end address detection signal EA1 rises to "1" (i.e., when the note clock signal $\phi_n$ is at the "1" level), the tone color changing control signal CMS is "0", so that the sampled data contained in the end address "M−1" is read from the RAM 155. The read sampled data is then stored into the latch 171 and thence outputted to the multiplier 172 as described above for the case (1). Thus, when the operation timing signal $\phi_o$ rises from "0" to "1", the tone color changing control signal CMS does not rise simultaneously but rises after the sampled data contained in the last address "M−1" has been read from the RAM 155. The tone color changing control signal CMS maintains its "1" state until the second address counter 168 completes the counting from "0" to "M−1", and is then rendered "0" (see FIG. 11).

During the time when the tone color changing control signal CMS is "1", the selector 169 supplies the second address data ADR2, which varies from "0" to "M−1", to the address data input terminal AD of the RAM 155, as described above for the case (1). As a result, the addresses "0" to "M−1" of the RAM 155 are sequentially accessed in synchronism with the positive-going edges of the master clock signal $\phi_m$.

In the case of the address "0" of the RAM 155 being accessed, when the master clock signal $\phi_m$ is at the "1" level, the inverted master clock signal is $\phi_m$ in the "0" level. Therefore, the output of the AND gate 155*a* to the mode selection terminal W/$\overline{R}$ of the RAM 155 is "0", so that the the RAM 155 is in the read mode. As a result, the sampled data stored in the address "0" of the RAM 155 is read out. At this time, both of the tone color changing control signal CMS and the master clock signal $\phi_m$ supplied to the AND gate 156*e* (FIG. 6) are at the "1" level, so that the sampled data read from the address "0" is stored into the latch 156*a* and the delay circuit 156*b*.

Then, when the master clock signal $\phi_m$ is rendered "0", the inverted master clock signal $\phi_m$ becomes "1", so that both inputs to the AND gate 155*a*, i.e., the tone color changing control signal CMS and the inverted master clock signal $\phi_m$, are rendered "1". Therefore, the output of the AND gate 155*a* to the mode selection terminal W/$\overline{R}$ of the RAM 155 becomes "1", so that the RAM 155 is brought into the write mode. At this time, the key-on pulse KONP supplied to the AND gate 157*b* is "0", so that the gate circuit 157 is open. In this case, no sampled data is supplied from the waveform generator 152 through the delay circuit 153 to the adder 154. As a result, the data input terminal IN of the RAM 155 is supplied only with the sampled data from the digital filter 156. This sampled data is the data obtained by adding at the adder 156*d* the sampled data stored in the latch 156*a* (FIG. 6) to the sampled data precedingly stored in the delay circuit 156*b* and multiplied by the filter factor K by the multiplier 156*c*. The sampled data thus supplied to the data input terminal IN is written into the address "0" of the RAM 155. In this case, the value of the sampled data outputted from the delay circuit 156*b* is not certain since this sampled data has been precedingly stored. From the second cycle of modification of the waveform data, however, the sampled data outputted from the delay circuit 156b at such a timing is the sampled data read from the end address "M−1" of the RAM 155, so that the uncertainty of the sampled data in the first cycle of modification of the waveform data has little effect on the feature of this embodiment in which the musical tone generated immediately after a key depression contains many high-frequency components. Particularly where the waveform data outputted from the waveform generator 152 upon depression of a key represents a random waveform, the uncertainty does not affect the feature of the embodiment at all. In the case where the waveform data outputted from the waveform generator 152 is composed of a group of sampled data at least one of which represents "0" as those of a square wave, a saw-tooth wave, a triangular wave or the like, the uncertainty will have no effect if the Mth sampled data generated by the waveform generator 152 is set to "0" so that the sampled data stored in the address "M−1" of the RAM 155 upon depression of a key becomes "0" and if the delay circuit 156b is modified to clear the contents thereof in response to the depression of key. Alternatively, the delay circuit 156b may be modified so that the Mth sampled data outputted from the waveform generator 152 upon depression of a key is stored into the register of the delay circuit 156b irrespectively of the kind of waveform data.

When the master clock signal $\phi_m$ again rises to "1", the second address data ADR2 represents "1", so that the address "1" of the RAM 155 is accessed. Then, the sampled data contained in the address "1" is read from the RAM 155 and is stored into the latch 156a and the delay circuit 156b, in a manner described above for the address "0". In this case, the delay circuit 156b outputs the sampled data stored one clock time of the master clock signal $\phi_m$ before the storing of the supplied sampled data, so that the sampled data outputted from the delay circuit 156b is that read from the address "0" of the RAM 155. Then, when the master clock signal $\phi_m$ again falls to "0", the data obtained by adding the sampled data outputted from the latch 156a to the sampled data outputted from the delay circuit 156b and multiplied by the filter factor K is written into the address "1" of the RAM 155, in a manner described above for the address "0". Thus, the data in the address "1" of the RAM 155 is changed to the data obtained by effecting arithmetic operations on those data precedingly stored in the addresses "0" and "1" by the multiplier 156c and the adder 156d.

In this manner, each of the sampled data in the RAM 155 is changed or modified every one cycle of the master clock signal $\phi_m$. And, when the second address data ADR2 becomes equal to "M−1", the data obtained by effecting the arithmetic operations on those data precedingly stored in the addresses "M−2" and "M−1" is written into the address "M−1". Thus, the modification of all sampled data in the RAM 155 is completed. At this time, the delay circuit 156b is loaded with the sampled data precedingly stored in the address "M=1" of the RAM 155. Then, the tone color changing control signal CMS is rendered "0" to prevent the "1" signal from being outputted from the AND gate 156e, so that the sampled data loaded on the delay circuit 156b is held in the register of the delay circuit 156b. During the next cycle of modification of the waveform data, the sampled data held in the register of the delay circuit 156b and the modified sampled data contained in the address "0" of the RAM 155 are subjected to the arithmetic operations by the multiplier 156c and the adder 156d, and written into the address "0" of the RAM 155, so that the continuity of the waveform data is maintained.

When the note clock signal $\phi_n$ rises to "1" after the modification of the waveform data has thus been completed, the value of the first address data ADR1 is changed from "M−1" to "0" (see FIG. 11), so that the first sampled data of the modified waveform data contained in the RAM 155 is read out and stored into the latch 171. The latch 171 has stored the Mth sampled data of the waveform data before modification until the first sampled data is thus stored thereinto, so that the order of the sampled data outputted from the latch 171 will not be disturbed. In other words, the period of the master clock signal $\phi_m$ is short enough to modify all the sampled data in the RAM 155 during the time interval between adjoining pulses of the note clock signal $\phi_n$.

Thereafter, the sampled data stored in the RAM 155 are sequentially read out in accordance with the first address data ADR1. Each time the tone color changing control signal CMS is outputted from the tone color changing control signal generator 183, the sampled data stored in the RAM 155 are modified in the aforesaid manner, so that the musical tone produced by the sound system 175 gradually changes with the time. In addition, as the digital filter 156 of FIG. 6 acts as a low-pass filter, the high-frequency components of the musical tone generated are gradually decreased.

When the key thus depressed is released, the musical tone generated rapidly decreases and ceases in a manner described above for the apparatus 100. In the case where a decay-type tone such as a piano tone and a harpsichord tone is selected by the tone color selection switch circuit 151, the musical tone generated gradually decreases and ceases even if the key is kept depressed.

As will be appreciated from the above-described operation of the apparatus 140, when a key is newly depressed on the keyboard, the waveform data generated by the waveform generator 152 and containing many high-frequency components is repeatedly read from the RAM 155 in accordance with the note clock signal $\phi_n$ during a period immediately after the depression of the key. Thereafter, as the operating timing signals $\phi_o$ are generated during the reading of the waveform data from the RAM 155, the waveform data is gradually modified by the digital filter 156 to have a fewer high-frequency components. As a result, the tone color of the musical tone generated gradually changes with time. The operation timing signal $\phi_o$, which determines each timing of modification of the waveform data, is independent of the note clock signal $\phi_n$, and the generation of the operating timing $\phi_o$ is controlled by the operation timing signal generator 183a in accordance with the tone color selection data TC and the key code KC. Therefore, the rate of change of the tone color of the musical tone generated is set to an appropriate value in accordance with the tone color selected by the tone color selection switch circuit 151 and the tone pitch of the key depressed on the keyboard.

If the pitch modulation data generator 165 is operated to modify the first address data ADR1 in accordance with the frequency changing data generated thereby, the musical tone generated will be given a musical effect such as a vibrato, a glide, an attack pitch and a pitch control (pitch shift), whereby the quality of the generated musical tone is improved.

With the apparatus 140 described above, only one RAM (RAM 155) is provided for storing the waveform data, and the waveform data is modified at a high rate using a fraction of each time period during which the waveform data is read out in accordance with the pulses of the note clock signal $\phi_n$. The apparatus 140 may be modified to have a pair of RAMs arranged in parallel and each equivalent to the RAM 155. Each of the RAMs is used alternately, in response to each timing for modifying the waveform data, as a RAM for outputting the waveform data in accordance with the note clock $\phi_n$ and as a RAM for modifying the waveform data. More specifically, the waveform data is outputted, in accordance with the note clock signal $\phi_n$, from that RAM which had been used as the RAM for modifying the waveform data until the latest wavefor-modifying timing. On the other hand, the waveform data thus outputted in accordance with the note clock signal $\phi_n$ is subjected to the arithmetic operations and stored into that RAM which had been used as the RAM for outputting the waveform data until the latest waveform-modifying timing. With this modification, although the number of RAMs used increases, the speed of the arithmetic operations can be decreased, so that the circuitry of this apparatus 140 operates with enough margin or tolerance, whereby errors of the circuitry can be prevented and complicated arithmetic operations can be performed in the apparatus 140.

With the apparatus 140, the waveform generator 152 generates, in response to a key depression, the waveform data representative of one cycle of a musical tone wave such as a square wave, a saw-tooth wave, a triangular wave and a random wave. The waveform generator 152 may be modified to generate waveform data representative, for example, of an impulse wave and greater in amount than that representative of one cycle of a musical tone wave, as the apparatus 100. In this case, the waveform generator 152 is further modified to output the sampled data constituting the waveform data to the adder 154 in accordance with the tone color changing control signal CMS. As a result, even sufficiently after the key depression, the sampled data generated by the waveform generator 152 is added by the adder 154 to the sampled data outputted from the digital filter 156 each time the tone color changing control signal CMS becomes "1". The result of the addition is written into the RAM 155 to thereby modify the waveform data in the RAM 155.

The apparatus 140 may also be modified such that the waveform data outputted from the RAM 155 is subjected to an interpolation operation before being supplied to the multiplier 172, as the apparatus 100.

Although each of the above-described apparatuses 100 and 140 is in the form of a monophonic electronic musical instrument, it will be evident that the present invention can be applied to a polyphonic electronic musical instrument having a plurality of tone generating channels. In this case, for example, tee circuit portion composed of the waveform data forming-and-storing section 150, the address data generating section (except for the key switch circuit 161 and the key depression detection circuit 162) and the waveform data changing timing control section 180 may be provided physically individually for each of the plurality of tone generating channels. Alternatively, the circuit portion of such sections may be used by the plurality of tone generating channels in a time sharing manner. Thus, the keys detected by the key depression detection circuit 162 are assigned physically or in a time sharing manner to the different tone generating channels. Furthermore, although each of the above-described first and second embodiments is applied to an electronic musical instrument having a keyboard, the present invention can also be applied to a tone generating apparatus having no keyboard such as an automatic music playing apparatus. In this case, a series of key-depression and key-release data previously stored in the automatic music playing apparatus are sequentially read out, and the key codes KC, the key-on signals KON and the key-on pulses KONP are formed in accordance with these read data. Then, the key codes KC, the key-on signals and the key-on pulses KONP thus formed are supplied to the respective circuits.

What is claimed is:

1. A musical tone signal generating apparatus comprising:

(a) a memory means for storing tone wave data in the form of plural sampled values of a tone wave;

(b) pitch data generating means for generating pitch data representative of a tone pitch of a musical tone signal to be generated;

(c) readout means responsive to said pitch data for repeatedly reading out said tone wave data from said memory means at a rate corresponding to said tone pitch to form said musical tone signal;

(d) modification means for modifying said tone wave data for outputting modified tone wave data representative of a modified tone wave; and (e) replacing means for replacing said tone wave data with said modified tone wave data in said memory means at a time interval independent of said rate, whereby said musical tone signal has said tone pitch and varies in waveshape at said time interval independent of said tone pitch.

2. A musical tone signal generating apparatus according to claim 1, wherein said modification means comprises an operation means for subjecting said tone wave data to a predetermined operation to form said modified tone wave data.

3. A musical tone signal generating apparatus according to claim 2, wherein said operation means comprises a multiplier receiving said tone wave data for multiplying said tone wave data by a predetermined coefficient to output a multiplication result, said multiplication result being used to produce said modified tone wave data and said predetermined coefficient being chosen to produce the desired variation in the waveshape.

4. A musical tone signal generating apparatus according to claim 3, wherein said modification means further comprises n adder for adding said tone wave data generated from said tone wave generator to said multiplication result to output an addition result, said addition result being used to produce said modified tone wave data.

5. A musical tone signal generating apparatus according to claim 2, wherein said operation means comprises a digital filter receiving said tone wave for digitally filtering said tone wave in accordance with a predetermined filter characteristic and for outputting a digitally filtered tone wave, said digitally filtered tone wave being used to produce said modified tone wave data and said predetermined filter characteristic being chosen to produce the desired waveshape variation.

6. A musical tone signal generating apparatus according to claim 1 wherein the pitch data generating means comprises:

pitch changing data generating means for generating pitch changing data representative of the amount by which said tone pitch of said musical tone signal is to be changed;

key pitch data generating means for generating key pitch data representative of a nominal tone pitch of a musical tone signal to be generated; and combining means for combining said pitch changing data with said key pitch data to form said pitch data.

7. A musical tone signal generating apparatus according to claim 1 further comprising a wave generator for generating said tone wave data, and wherein said memory means is connected to said wave generator for receiving said tone wave data.

8. A musical tone signal generating apparatus according to claim 1, wherein said memory means is comprised of a shift register having a feedback path for recirculation of the contents thereof, said shift register containing plural stages equal in number to said plural sampled values, said plural sampled values being initially loaded respectively to said plural stages and being shifted at said rate.

9. A musical tone signal generating apparatus according to claim 1, wherein said readout means comprises a selector for selectively reading out and outputting one among said plural sampled values from said memory means in accordance with said pitch data.

10. A musical tone signal generating apparatus according to claim 8, wherein said readout means comprises:

a first selector for outputting selectively one among said plural sampled values from said memory means in accordance with said pitch data;

a second selector responsive to said pitch data for outputting selectively another one among said plural sampled values from said shift register; and interpolation operation means for subjecting said two sampled values outputted from said first selector and said second selector to an interpolation operation to output interpolated sampled data as the output of said readout means.

11. A musical tone signal generating apparatus according to claim 1, wherein said memory means comprises a random access memory having a plurality of addresses for respectively storing said plural sampled values, each of said plurality of addresses being identified by corresponding address data, said address data being used to access the identified address in order to perform read or write operations thereon.

12. A musical tone signal generating apparatus according to claim 11, wherein said memory means further comprises a selector for selectively supplying to said random access memory one of first address data and second address data as said address data, said readout means comprises first address data generating means for repeatedly generating at said rate a group of address data each group sequentially indicating said plurality of addresses, said address data generated by said first address generating means being supplied to said selector as said first address data, said readout means further comprising first control means for causing said selector to supply said first address data to said random access memory to thereby read therefrom said plural sampled values at said rate, said modification means comprises second address data generating means for repeatedly generating at said time interval a group of address data each group sequentially indicating said plurality of addresses, said address data generated by said second address data generating means being supplied to said selector as said second address data, said modification means further comprising second address data to said random access memory to access the plurality of addresses, said modification means further comprising a digital filter for subjecting the sampled values outputted from each accessed address to a filtration operation to modify the sampled values, said second control means writing the modified sampled values into said each accessed address, said filtration operation having predetermined characteristics chosen to produce the desired waveshape variation.

13. A musical tone signal generating apparatus according to claim 12 further comprising:

pitch changing data generating means for generating pitch changing data representative of the amount by which said tone pitch of said musical tone signal is to be changed; and combining means for combining said pitch changing data with said address data generated by said first address data generating means to form combined data;

said combined data being supplied to said selector as said first address data.

* * * * *